US006620991B1

(12) United States Patent
Honiball

(10) Patent No.: US 6,620,991 B1
(45) Date of Patent: Sep. 16, 2003

(54) PERCUSSION INSTRUMENT

(76) Inventor: Houlton Honiball, 48-298 Silverstone Dr., Etobicoke (CA), M9V3J4

( * ) Notice: Subject to any disclaimer, the term of this patent is extended or adjusted under 35 U.S.C. 154(b) by 0 days.

(21) Appl. No.: 10/092,156

(22) Filed: Mar. 6, 2002

(51) Int. Cl.[7] ..... G10D 13/08
(52) U.S. Cl. ..... 84/402; 84/418
(58) Field of Search ..... 84/402, 403, 404, 84/406, 410, 417, 418

(56) References Cited

U.S. PATENT DOCUMENTS

| | | | | | |
|---|---|---|---|---|---|
| 4,244,267 | A | * | 1/1981 | Nemeth | 84/418 |
| D336,488 | S | * | 6/1993 | Grey | D17/22 |
| 5,323,678 | A | * | 6/1994 | Yould | 84/418 |
| 5,483,859 | A | * | 1/1996 | Singer | 84/322 |

* cited by examiner

*Primary Examiner*—Kimberly Lockett
(74) *Attorney, Agent, or Firm*—Gifford, Krass, Groh, Sprinkle, Anderson & Citkowski, P.C.

(57) ABSTRACT

Known percussion instruments, employing conduits and free-moving rattle members therein, are inefficient for producing louder sounds without increased effort on a user's behalf. The present invention provides a plurality of spaced-apart conduits having first and second opposed open ends. A pair of planar, spaced-apart frame members is provided, with one frame member closing all of the conduit first ends, and the second frame member closing all of the conduit second ends. There is at least one free-moving rattle member inside each conduit. The frame members provide a common striking surface for the free-moving rattle members. The simultaneous striking of a common surface by free-moving rattle members produces an increase in sound volume with less work on the user's behalf.

10 Claims, 3 Drawing Sheets

PERCUSSION INSTRUMENT

FIELD OF INVENTION

The present invention relates to musical instruments and more particularly, to percussion instruments.

BACKGROUND OF THE INVENTION

Percussion instruments providing conduits and free-moving rattle members therein, are generally known. To produce percussive sounds or music, these instruments are normally held in a user's hand, and shaken from side to side. To increase the volume of the sound produced, the user may optionally shake the instrument with more force, or strike the instrument against a body part (such as a palm of the user's hand, or a thigh of the user's leg).

Prior known configurations of such percussion instruments are not efficient for producing louder sounds (without increased effort on the user's behalf). Such instruments typically provide one or more conduits with free-moving rattle members inside each conduit. In operation, the free-moving rattle members strike end surfaces of the individual conduits.

An example of a percussion instrument providing a conduit and free-moving rattle members therein is shown in U.S. Pat. No. 5,659,146, issued to Isackson. This patent shows a single conduit having a pair of diaphragms sealed over opposed ends of the conduit, the conduit being filled with free-moving rattle members. As only one conduit is provided, the ability to produce louder sounds without extra work on the user's part is lacking.

Other examples of percussion instruments showing a plurality of conduits with free-moving rattle members contained therein are shown in U.S. Pat. No. 4,165,671, issued to De Bose, U.S. Pat. No. 4,306,485, issued to Rudkin, and U.S. Pat. No. 5,323,678, issued to Yould. These configurations are also inefficient for producing louder sounds without extra work on the user's part.

SUMMARY OF THE INVENTION

The present invention provides a percussion instrument of simple construction, wherein free-moving rattle members strike a common surface to produce louder sounds without additional work on a user's part.

According to the invention, there is provided a plurality of spaced-apart conduits having first and second opposed open ends. A pair of planar, spaced-apart frame members is provided, with one frame member closing all of the conduit first ends, and the second frame member closing all of the conduit second ends. There is at least one free-moving rattle member inside each conduit.

BRIEF DESCRIPTION OF THE DRAWINGS

Preferred embodiments of the invention will now be described, by way of example, with reference to the accompanying drawings, in which.

DESCRIPTION OF THE PREFERRED EMBODIMENTS

Figure 1:
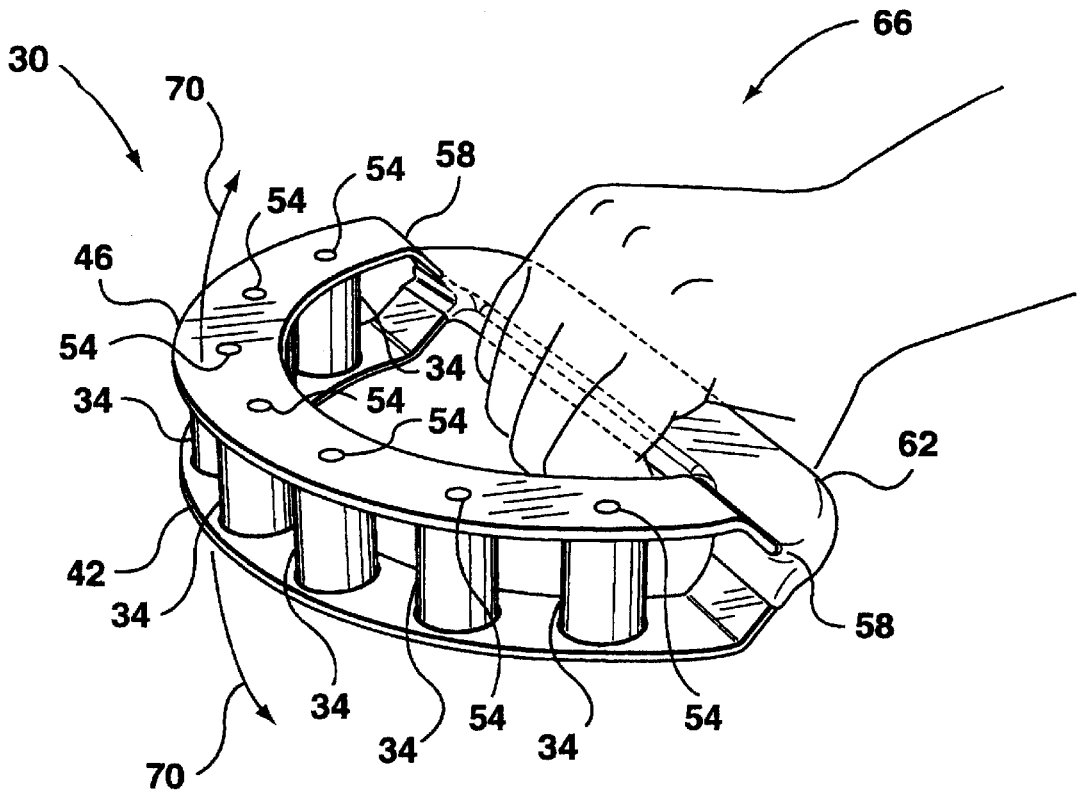
FIG. 1 is a perspective view of a preferred embodiment of the percussion instrument according to the present invention.

Referring to the drawings, a preferred embodiment of a percussion instrument according to the present invention is generally indicated by reference numeral 30 (see FIG. 1). The instrument 30 provides a plurality of conduits 34. Each conduit 34 contains at least one free-moving rattle member 38 (see FIG. 3). The conduits 34 may be made of plastic, aluminium, copper or any other suitable material(s), depending upon the musical pitch, tone, volume and quality desired. The conduits 34 are of similar dimension and shape, and are spaced apart. Each conduit 34 has two opposed open ends (not shown).

The free-moving rattle members 38 can vary in size, with larger sizes being desirable for louder, more accentuated sounds. The rattle members 38 may be made of steel, aluminium, copper, dried peas, dried rice, or other suitable material(s) to effect a desired musical result. Similarly, the number of rattle members 38 in each or all conduit(s) 34 may also be varied for the same reason.

Figure 4:
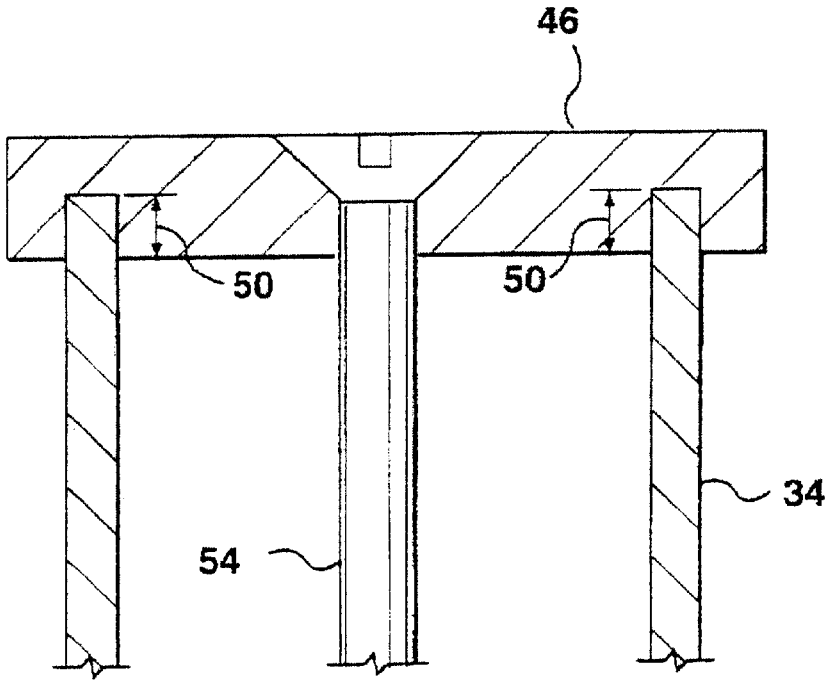
FIG. 4 is an enlargement of the encircled area 74 in FIG. 3, showing a recess in a frame member for receiving the conduit.
Figure 5:
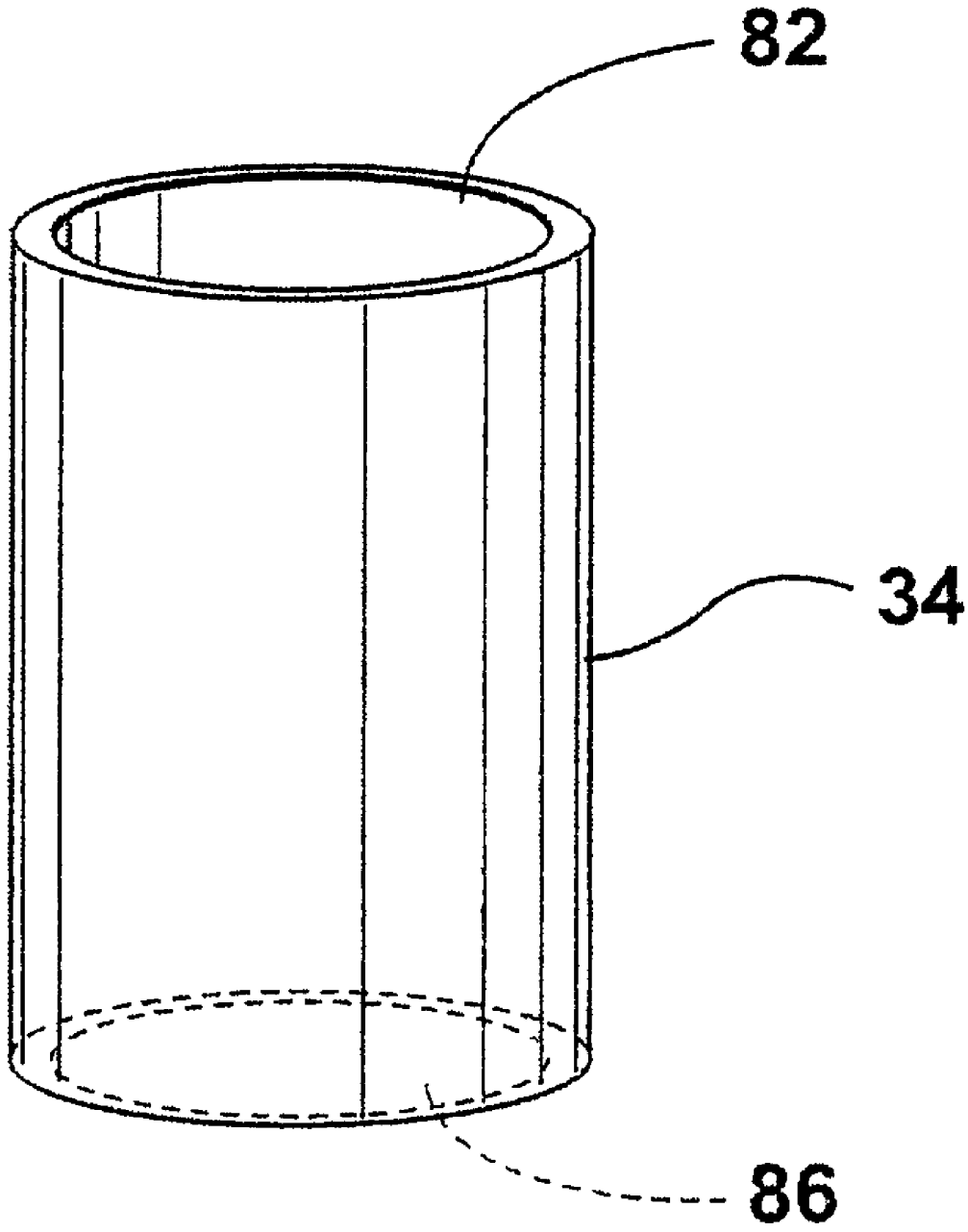
FIG. 5 is a perspective view of a selected conduit and illustrating its first and second open ends.

The conduits 34 are closed at both ends 82 and 86 by a pair of planar, spaced-apart frame members 42, 46 (see FIG. 1). The frame members 42, 46 are made preferably of aluminum, but may be made of any suitable material(s) depending upon desired musical result. Both frame members 42, 46 provide recesses 50 (best seen in FIG. 4) to seat the conduits 34 therein. The frame members 42, 46 are crescent shaped, with two opposing ends 58 (see FIG. 2).

The thickness of the frame members 42,46 can be varied to alter the sound characteristics of the instrument 30. A thicker frame member 42, 46 will generally produce a deeper, harder sound. A thinner frame member 42, 46 will generally produce a higher, lighter sound. The frame members 42, 46 are of at least a minimal thickness so that recesses 50 may be provided to receive the conduits 34, and structural integrity maintained.

The frames 42, 46, when constructed with aluminium, are preferably between about 0.69–0.13 inches (1.75–3.25 millimeters). A frame member 42,46 (when made with aluminium) may be less than 0.69 inches (1.75 millimeters) thick, but may compromise the structural integrity of the instrument 30, and not normally allow for the provision of a suitable recess 50. A frame member 42,46 (when made with aluminium) may be more than 0.13 inches (3.25 millimeters) thick, but may compromise the sound quality and volume produced by the instrument 30.

Figure 3:
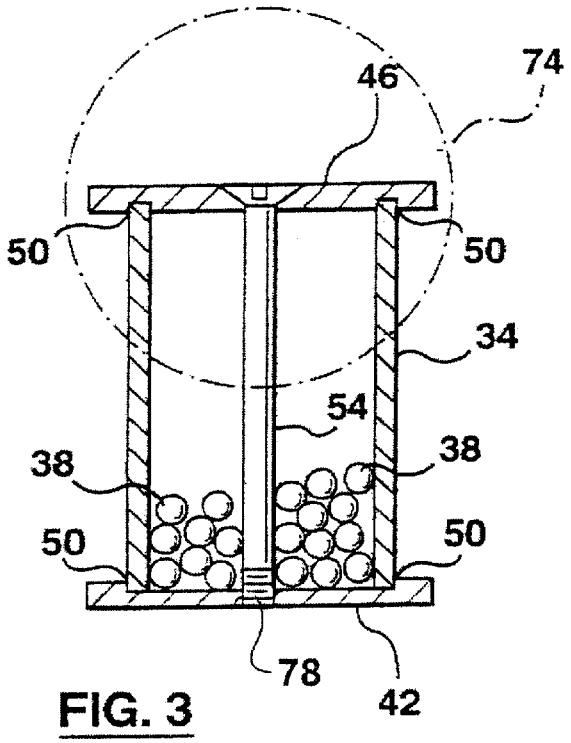
FIG. 3 is a cross-section view taken along the lines 3-3 in FIG. 2, showing free-moving rattle members contained within a conduit.

A threaded fastener 54 (see further threads 78) is inserted through one frame member 46, passes through the conduit 34, and exits the other frame member 42 (best seen in FIG. 3). The fastener 54 rigidly secures the conduit 34 in recesses 50, giving the instrument 30 stability and durability. Where the fastener 54 exists the frame member 42, the fastener 54 is truncated so as to be flush with the frame member 42. The fastener 54 is truncated primarily for reasons of safety and aesthetics.

Figure 2:
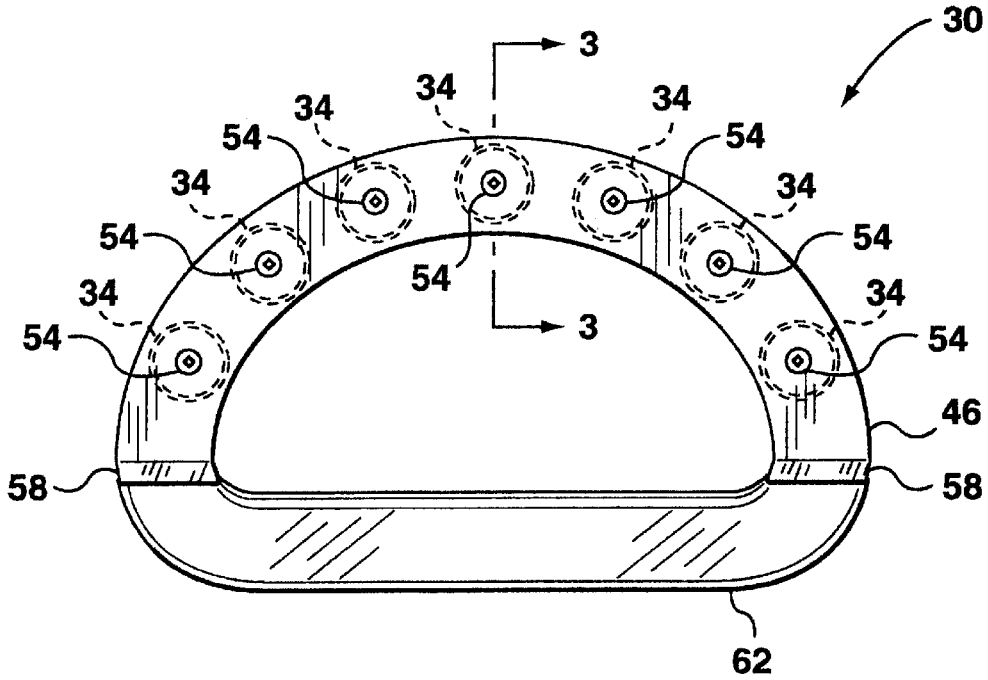
FIG. 2 is a plan view of the percussion instrument shown in FIG. 1.

A handle 62 is provided on each frame member 42, 46 at the opposing ends 58 (see FIG. 2). The handle 62 is an integral extension of the frame members 42, 46, and each handle 62 is secured to the other with fasteners (not shown). The handles 62 are coated with PLASTI DIP™

(manufactured by PDI Inc. of Minnesota, U.S.A.) to improving gripping. The handles 62 may be coated with other suitable material(s) to improve gripping and/or comfort.

In use, the user grasps the instrument 30 (usually at the handle 62) with his hand 66, and shakes the instrument 30 in a side to side motion (as indicated by the arrows 70 in FIG. 1) to produce a percussive sound. In the alternative, the user can grasp the instrument 30 with his hand 66, and repeatedly apply pressure from his fingertips (not shown), against the handle 62 or frame member 42, 46, followed by release of said pressure (thus producing a side to side motion), to produce a percussive sound.

When the instrument 30 is at rest, the free-moving rattle members 38 rest against a common frame member 42 (see FIG. 3). When the instrument 30 is shaken, the rattle members 38 move from one frame member 42 to the other frame member 46, striking the other frame member 46 at approximately the same time. As shaking continues, the rattle members 38 move back toward the first frame member 42, and strike said frame member 42 at approximately the same time. This pattern of movement and striking repeats for as long as the user continues to shake the instrument 30.

What is claimed is:

1. A percussive instrument comprising:

a plurality of spaced-apart conduits, each of the conduits having a first open end and a second open end;

a pair of planar, spaced-apart, frame members, the conduits securing to opposing and common surfaces of the spaced apart frame members and such that a first of the frame members closes all of the conduit first ends and the second frame member closes all of the conduit second ends; and at least one free-moving rattle member contained within each of the conduits;

upon agitating the percussive instrument, the rattle members striking the common surfaces.

2. A percussive instrument as claimed in claim 1 wherein the frame members have first and second opposed ends, the frame members being crescent-shaped.

3. A percussive instrument as claimed in claim 2 further comprising a handle attached to the frame member ends.

4. A percussive instrument as claimed in claim 3 wherein the handle and the frame members are integral.

5. A percussive instrument as claimed in claim 1 wherein the conduits are hollow circular cylinders.

6. A percussive instrument as claimed in claim 1 wherein the conduits are hollow square cylinders.

7. A percussive instrument as claimed in claim 1 wherein the frame members define recesses to receive the conduits therein.

8. A percussive instrument as claimed in claim 1 further comprising threaded fasteners engaging the frame members to compress said frame members against the conduit open ends.

9. A percussive instrument as claimed in claim 1 wherein the frame members are made from aluminium.

10. A percussive instrument as claimed in claim 9 wherein the frame members are between about 0.69–0.13 inches (1.75–3.25 millimeters) thick.

* * * * *